US008539991B1

(12) United States Patent
Carmack et al.

(10) Patent No.: US 8,539,991 B1
(45) Date of Patent: Sep. 24, 2013

(54) VAPOR RECOVERY FUEL DISPENSING NOZZLE

(75) Inventors: Cameron D. Carmack, Tipp City, OH (US); David L. Imler, Tipp City, OH (US)

(73) Assignee: Veeder-Root LLC, Simsbury, CT (US)

( * ) Notice: Subject to any disclaimer, the term of this patent is extended or adjusted under 35 U.S.C. 154(b) by 338 days.

(21) Appl. No.: 12/807,888

(22) Filed: Sep. 16, 2010

(51) Int. Cl.
*B65B 1/30* (2006.01)
*B67D 7/48* (2010.01)

(52) U.S. Cl.
CPC ..... *B67D 7/48* (2013.01)
USPC ..... 141/206; 141/59; 141/285; 141/302

(58) Field of Classification Search
USPC ..... 141/59, 206, 285, 301, 302, 392, 141/DIG. 1, 219
See application file for complete search history.

(56) References Cited

U.S. PATENT DOCUMENTS 4,071,059 A * 1/1978 Hansel ..... 141/206
4,359,074 A * 11/1982 Maruyama et al. ..... 141/94
4,649,970 A * 3/1987 Bower et al. ..... 141/302
4,697,624 A 10/1987 Bower et al.
5,224,525 A * 7/1993 Weichel ..... 141/207
5,255,723 A 10/1993 Carmack et al.
5,289,856 A 3/1994 Strock et al.
5,417,259 A * 5/1995 Schneider ..... 141/59
5,474,115 A * 12/1995 Fink, Jr. ..... 141/206
5,562,133 A * 10/1996 Mitchell ..... 141/206
5,655,576 A 8/1997 Leininger
6,334,470 B2 * 1/2002 Healy ..... 141/59
6,951,229 B2 10/2005 Garrison
7,082,972 B1 8/2006 Healy

* cited by examiner

*Primary Examiner* — Timothy L Maust
(74) *Attorney, Agent, or Firm* — Nelson Mullins Riley & Scarborough, LLP

(57) ABSTRACT

A vacuum-assist fuel dispensing nozzle has a body defining a fuel supply passage and a vapor return passage each having a control valve operated simultaneously by a hand actuated lever pivotally connected to an axially movable tubular member retained by a diaphragm actuated clutch. A fuel dispensing spout extends from the body and a fuel responsive poppet valve, and the spout encloses an air bleed passage which actuates the clutch. The housing supports a vapor flow responsive valve within the vapor passage and includes a ferrous valve member or disc movable within retainers between a closed position contacting an annular seat to block the flow of vapor and an open position permitting a free flow of vapor through the vapor passage. A circular magnet is supported by the retainers and magnetically attracts the valve disc to the closed position in response to no flow of vapor through the vapor passage.

13 Claims, 2 Drawing Sheets

VAPOR RECOVERY FUEL DISPENSING NOZZLE

BACKGROUND OF THE INVENTION

This invention relates to a vapor recovery fuel dispensing nozzle of the general type disclosed in U.S. Pat. No. 5,289,856 and U.S. Pat. No. 5,255,723, the disclosures of which are herein incorporated by reference. These nozzles have vapor return valves within the nozzle bodies and responsive to fuel supply within the nozzle. Other forms of vapor recovery fuel dispensing nozzles of the balanced-type where fuel vapors are displaced from the vehicle fuel tank back into the underground tank, are disclosed in U.S. Pat. Nos. 4,697,624, 5,655,576, 6,951,229, and 7,082,972. In such a fuel dispensing nozzle assembly, a collapsible corrugated rubber bellows surrounds a fuel supply spout and defines therebetween a vapor return passage connected to a vapor return passage within the nozzle body and within a co-axial fuel supply hose. When a nozzle spout is inserted into a fuel fill tube or pipe projecting from a fuel tank of a motor vehicle, an annular vapor seal carried by the bellows engages the lip of the fill pipe. In some nozzles, as the bellows is axially compressed by further pressure on the nozzle, a valve within the vapor passage opens. Axial compression of the bellows may also actuate a diaphragm operated ball clutch which locks an axially movable stem to the nozzle body to form a fixed pivot support for a hand actuated lever connected to control a valve within the fuel supply passage.

When the annular resilient vapor seal of a vacuum assist nozzle engages the fuel fill pipe on a vehicle, it is desirable to obtain and maintain a positive annular pressure seal between the resilient vapor seal and the fill pipe to assure that surrounding air is not sucked into the nozzle and that fuel vapors in the fuel tank transfer with minimal resistance through the vapor return passage within the nozzle. In addition, when a vacuum-assist nozzle engages a fuel fill pipe on a vehicle having an on-board refueling vapor recovery (ORVR) system, it is desirable for the nozzle to sense when there is no significant flow of return vapor through the nozzle so that a vapor return valve in the nozzle will restrict or stop the flow of vapor back into the underground fuel tank.

SUMMARY OF THE INVENTION

The present invention is directed to an improved vapor recovery fuel dispensing nozzle which provides the above desirable features of a vapor return valve which senses return vapor flow and avoids using a spring and/or a diaphragm which degrade over a period of use of the nozzle. A nozzle vapor return valve constructed in accordance with the invention also provides a consistent force for closing the vapor return valve over the life of the nozzle. In accordance with the invention, a fuel dispensing nozzle incorporates a magnetically controlled vapor return valve which is normally closed but moves to a fully open position in response to sensing the low pressure differential of a flow of return vapors within the vapor return passage so that the return flow of vapors is not restricted.

In accordance with the illustrated embodiment of the invention, a vapor valve incorporates a circular magnetically attractable disc of a ferrous material, and the disc is supported by retainers for axial movement in response to vapor flow from a lower closed position resting on an annular plastic seat member and an upper open position engaging the plastic retainers. The retainers also support a circular permanent magnet space below the disc and which normally holds the disc in its closed position seated on the annular seat member. When the vacuum-assist nozzle is dispensing fuel, the return vapor flow shifts the disc from its closed position to a fully open position to minimize any restriction to the return vapor flow. When the nozzle is dispensing fuel into the tank on a vehicle equipped with an ORVR system, the disc remains in its closed position so that the vapors are collected in the canister of the ORVR system. However, if the ORVR system is unable to retain all of the fuel vapors in the canister on the vehicle, the excess vapors which flow back into the nozzle are sufficient to move the disc upwardly to its open position so that the vapors may return to the underground storage tank.

Other features and advantages of the invention will be apparent from the following description, the accompanying drawings and the appended claims.

DESCRIPTION OF THE ILLUSTRATED EMBODIMENT

Figure 1:
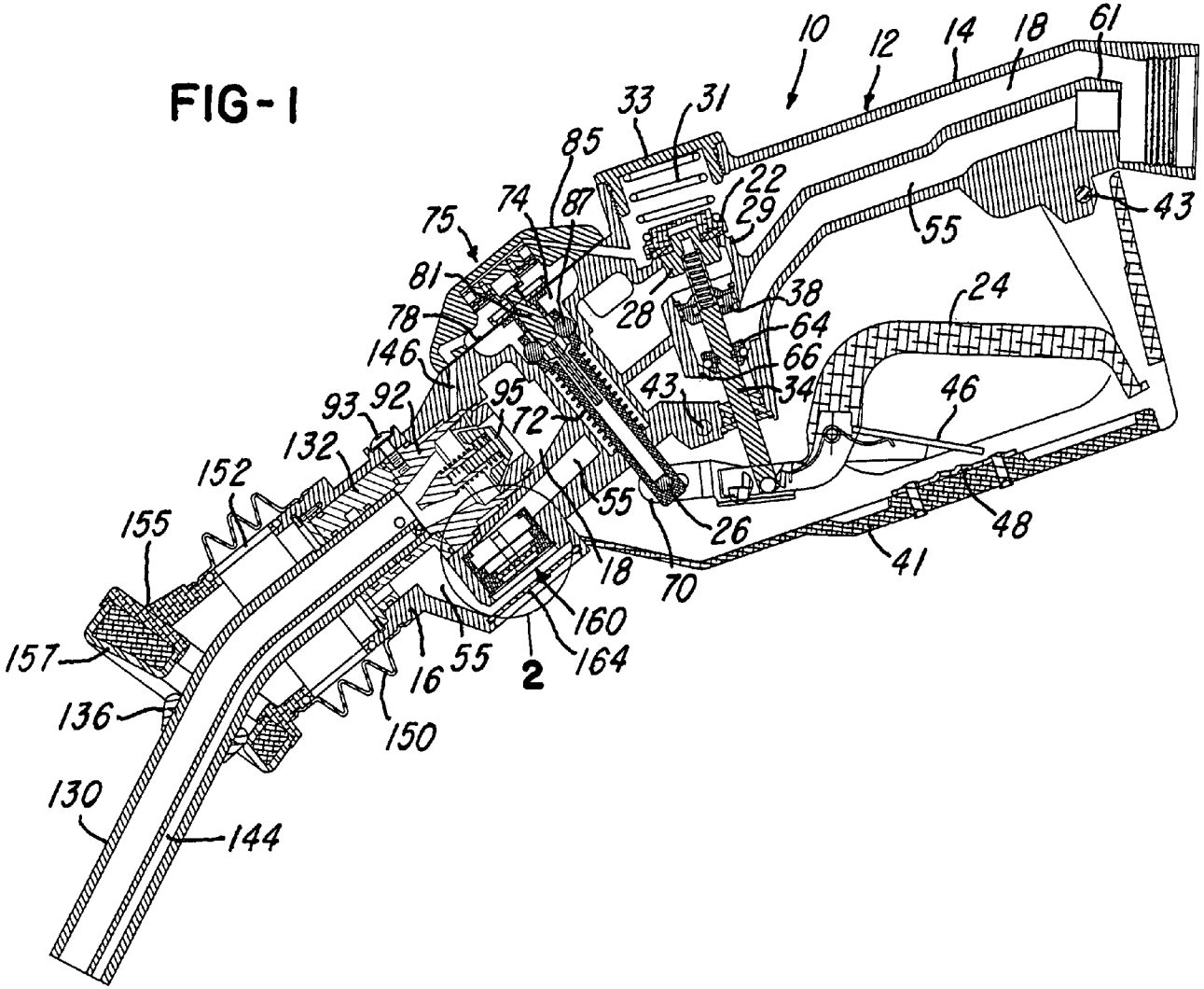
FIG. 1 is a vertical section of a vacuum-assist fuel dispensing nozzle enclosing a vapor flow responsive valve constructed in accordance with the invention.

FIG. 1 shows a vacuum-assist vapor recovery fuel dispensing nozzle assembly or nozzle 10 which includes a cast aluminum body 12 having a tubular handle portion 14 and an annular or cylindrical outlet portion 16. The body 12 defines an internal fuel supply passage 18, and a fuel flow control valve 22 controls the flow of fuel through the passage 18 in response to pivoting of a manually actuated control lever 24 about a pivot pin 26. The control valve 22 includes a valve member 28 within an annular seat member 29. The valve member 28 is normally closed by a compression spring 31, a spring support and a resilient washer confined by a cup-shaped plug 33 threaded into the body 12. A rod or stem 34 extends from the valve member 28 and engages the control lever 24, and a resilient O-ring surrounds the stem 34 and is retained within a plastic guide bushing 38 secured by a retaining ring and sealed to the body by a resilient O-ring. The control lever 24 is enclosed within a plastic lever guard 41 which is secured to the body 12 by a pair of cross pins 43. A spring biased lever 46 is connected to the actuating lever 24, and a plate 48 has a series of ribs for selectively receiving the end of the lever 46, in a conventional manner, when the valve control lever 24 is gripped and moved upwardly to open the fuel valve 22.

The body 12 also defines an internal vapor return passage 55 which extends within the fuel passage 18 within the handle portion 14. The vapor return passage 55 extends from an inner end portion 61 which receives a tubular fitting secured to one end of a flexible co-axial fuel supply and vapor return hose (not shown). The return flow of vapor through the return passage 55 is controlled by a metal or brass valve member 64 which is mounted on and sealed to the actuating stem 34 and carries a resilient O-ring which normally engages a tapered or frusto-conical seat 66 within the valve body. When the rod or stem 34 is moved upwardly in response to pivoting the lever 24, both the fuel supply valve member 28 and the vapor return valve member 64 move from their corresponding closed positions (FIG. 1) to their open positions and return to their closed positions when the control lever 24 returns to its released position (FIG. 1).

The forward end portion of the actuating lever 24 is pivotally supported by the lower end portion of a molded plastic tube or tubular member 70 which receives the pivot pin 26. The tubular member 70 is biased upwardly by a compression spring 72, and an enlarged upper end portion of the member 70 is locked to the nozzle body or released from the nozzle body by actuation of a ball clutch 74 forming part of an automatic shut-off mechanism 75. As generally disclosed in the above-mentioned U.S. Pat. No. 5,255,723, the mechanism 75 includes a flexible diaphragm 78 secured to a clutch stem 81 which is normally biased downwardly by a compression spring retained within a cap member 85 secured to the nozzle body. A set of balls 87 surround the clutch stem 81 and are retained within corresponding holes within the enlarged upper end portion of the tubular member 70 when the diaphragm is in its normal position shown in FIG. 1. In this position, the balls 87 are cammed outwardly by the stem 81 above an annular tapered shoulder within the body to lock the tubular member 70 to the body and thereby fix the pivot pin 26.

The forward end portion 16 of the nozzle body receives a fitting 92 which is retained by a screw 93 and supports a spring biased fuel control poppet valve 95 within the fuel supply passage 18. The poppet valve 95 operates in a manner as disclosed in above-mentioned '723 patent. The forward end portion 16 of the nozzle body also supports a rigid or metal fuel supply tube or spout 130 which has an inner end portion secured to a fitting 132 confined within the end portion 16 of the nozzle body contacting the fitting 92. The outer end portion of the spout 130 is adapted to project into a fuel inlet fill pipe or tube (not shown) projecting upwardly from a motor vehicle fuel tank. A collar 136 is secured to the spout 130 and is adapted to engage an inwardly projecting annular rib formed on the fill tube to secure the spout 130 to the fill tube and prevent it from sliding outwardly from the fill tube after the spout 130 is initially inserted into the fill tube. An overfill shut off air bleed passage 144 extends longitudinally within the spout 130 and has an inner end portion connected to a passage 146. The function of the air bleed passage 144 is the same as described in the '723 patent.

The forwarding portion 16 of the body 12 also supports a flexible corrugated compressible bellows 150 which encloses an annular compression spring 152. The spring 152 and bellows connect the forward end portion 16 to an annular cup member 155 which retains a resilient annular seal or gasket 157. When the nozzle 10 is used for dispensing fuel, the spout 130 is extended into the inlet tube (not shown) extending from a fuel receiving tank, and the gasket 157 engages the outer end of the fill tube with sufficient force to collapse the spring 152 and bellows 150 and form a seal between the gasket 157 and the fill tube and form a continuation of the vapor return passage 55.

In accordance with the present invention, the body 12 supports a vapor flow responsive control valve 160 (FIGS. 1 & 2) within the vapor return passage 55. After the valve is assembled, the valve 160 slides into a cylindrical bore 162 (FIG. 2) formed within the body 12 and is secured by a spring retaining ring 163. The valve 160 is inserted into the bore 162 through an aligned opening in the valve body and closed by a sealed disc 164. The valve 160 senses the low pressure return vapor flow within the vapor passage 55, and if there is no flow, the valve closes. When the valve 160 senses a return vapor flow, the valve opens fully and presents no restriction to the return vapor flow.

Figure 2:
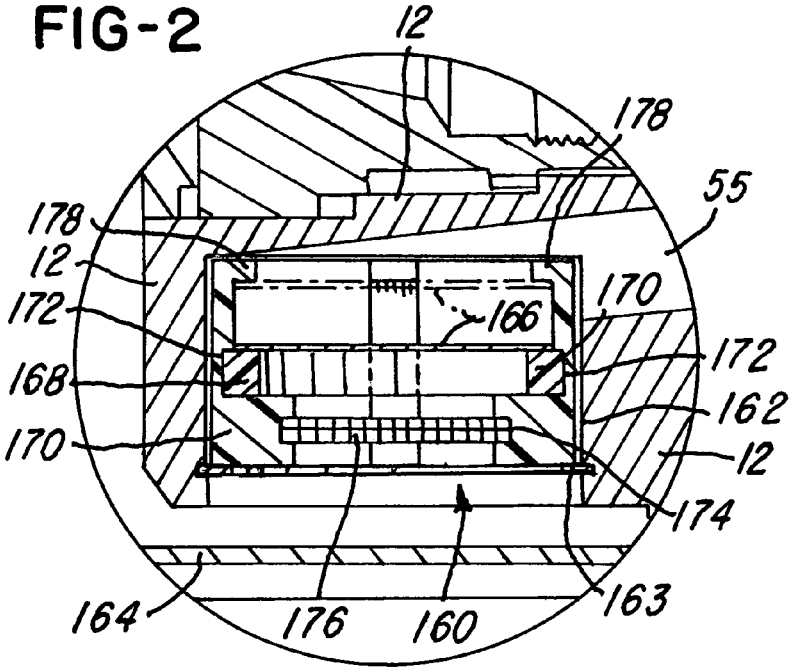
FIG. 2 is an enlarged vertical section of the vapor flow responsive valve shown in the circle 2 of FIG. 1.
Figure 3:
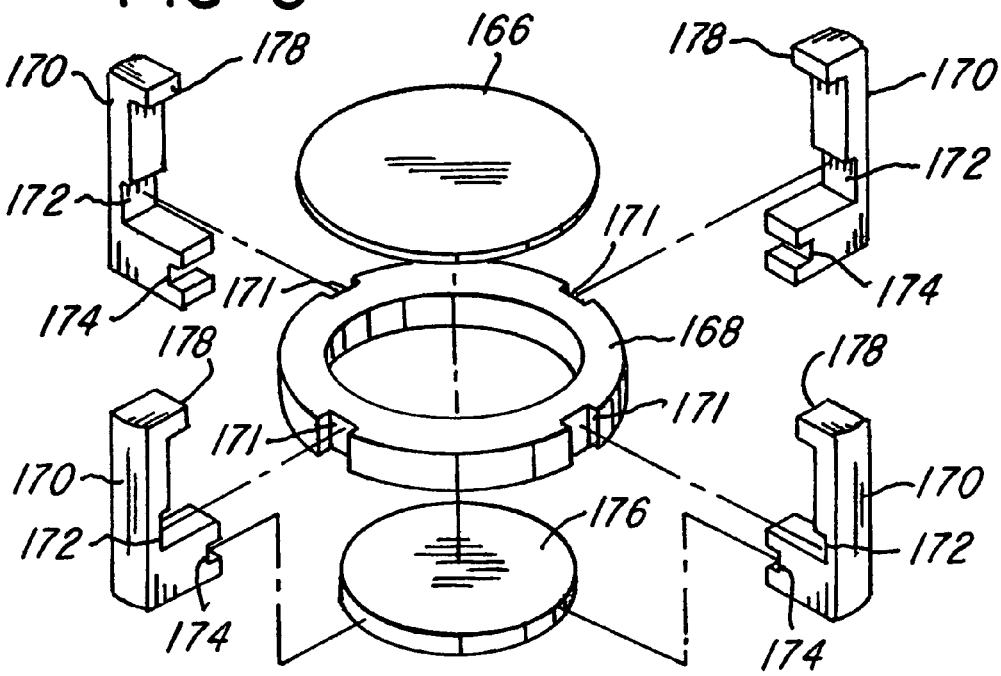
FIG. 3 is an exploded perspective view of the components of the vapor flow responsive valve shown in section in FIG. 2.

As shown in FIGS. 2 and 3, the valve 160 preferably includes a first magnetic valve member in the form of a flat circular disc 166 of a ferrous sheet metal. The disc 166 normally seats on an annular seat member 168 formed or molded of a plastics material such as an acetyl material. The annular seat 168 is supported within the bore 162 by four peripherally spaced molded plastic retainers 170, and the seat member 168 and retainers 170 have mating and interfitting notches 171 and 172 which position and lock the seat member 168 within the bore 162. The base portion of each retainer 170 also has a slot or groove 174 which cooperates to support a second magnetic valve member in the form of a circular permanent magnet 176. The magnet 176 is spaced below the seat 168 and provides a sufficient magnetic force or attraction to the disc 166 for normally holding the disc against the top surface of the seat 168, as shown in FIG. 2. When return vapor flows within the passage 55, the vapor flows upwardly around the magnet 176 and between the retainers 170 to press upwardly on the disc 166 and lift it from the seat 168. With only a light vapor flow, the disc 166 moves upwardly to a fully open position where it stops against the inwardly projecting stops or projections 178 on the retainers 170, as shown by the dotted position in FIG. 2. In this open position, the vapor is free to flow through the valve 160 and through the vapor return passage 55 without any significant restriction by the disc 166.

From the drawings and the above description, it is apparent that a vapor recovery fuel dispensing nozzle constructed in accordance with the invention provides desirable features and advantages. As one advantage, the vapor flow responsive control valve 160 remains normally closed until it senses a return vapor flow sufficient to open the valve from its closed position to its fully open position. This occurs on a vacuum-assist nozzle or when there is an overflow of vapors from the retention vapor canister on an ORVR type vehicle. Once the magnetic attraction between the magnet 176 and the disc 166 is overcome by the vapor flow, the disc 166 shifts upwardly to its fully open position since the magnetic attraction reduces as the disc moves upwardly. In addition, the magnetically actuated vapor flow control valve eliminates any springs which commonly degrade due to cyclic operation and also eliminates resilient or flexible diaphragms which degrade due to gasoline vapor environment. In addition, the permanent magnet forces are more consistent than springs and do not change due to cyclic operation. The metal disc 166 is also impervious to gasoline vapors.

While the form of nozzle and vapor flow responsive valve herein described constitute a preferred embodiment of the invention, it is to be understood that the invention is not limited to this precise form of the invention, and that changes made therein without departing from the scope and spirit of the invention as defined in the appended claims.

What is claimed is:

1. A vapor recovery fuel dispensing nozzle comprising a nozzle body defining a fluid supply passage and a valve for controlling the supply of fuel through said fuel supply passage, a hand actuated lever pivotally supported adjacent said body and connected to operate said fuel control valve, said body defining a vapor return passage and a vapor flow responsive control valve within said vapor return passage, said vapor flow responsive control valve including a first magnetic valve member movable between a closed position blocking the flow of vapor through said vapor return passage and an open position permitting the flow of vapor through said vapor return passage, a second magnetic valve member supported by said nozzle body and magnetically forcing said first magnetic valve member to said closed position, and a magnetic force between said first magnetic valve member and said second magnetic valve member effective to move said first magnetic valve member to said closed position in response to no flow of vapor through said vapor return passage.

2. A nozzle as defined in claim 1 wherein said first magnetic valve member comprises a magnetically attractable ferrous disc supported for movement within said vapor return passage between said open position and said closed position contacting an annular seat member, and said second magnetic valve member comprises a permanent magnet spaced from said disc.

3. A nozzle as defined in claim 2 wherein said disc is generally circular and substantially flat, and said permanent magnet is generally circular and substantially flat.

4. A nozzle as defined in claim 2 and including retainer members spaced circumferentially around said disc, said annular seat member and said magnet and supporting said disc, said seat member and said magnet within a bore in said nozzle body.

5. A nozzle as defined in claim 1 wherein said second magnetic valve member is supported by said nozzle body upstream of said first magnetic valve member with respect to the flow of vapor within said vapor return passage and magnetically pulls said first magnetic valve member to said closed position.

6. A vapor recovery fuel dispensing nozzle comprising a nozzle body defining a fluid supply passage and a valve for controlling the supply of fuel through said fuel supply passage, a hand actuated lever pivotally supported adjacent said body and connected to operate said fuel control valve, said body defining a vapor return passage and a vapor flow responsive control valve within said vapor return passage, said vapor flow responsive control valve including a ferrous disc member movable between a closed position contacting an annular seat member and blocking the flow of vapor through said vapor return passage and an open position spaced from said seat member and permitting the flow of vapor through said vapor return passage, a permanent magnet supported by said nozzle body and magnetically forcing said disc member to said closed position, and a magnetic force between said disc member and said magnet effective to move said disc member to said closed position in response to no flow of vapor through said vapor return passage.

7. A nozzle as defined in claim 6 and including retainer members spaced circumferentially around said disc, said annular seat member and said magnet and supporting said disc, said seat member and said magnet within a bore in said nozzle body.

8. A nozzle as defined in claim 6 wherein said disc member and said seat member are generally circular and substantially flat, and said permanent magnet is generally circular and substantially flat.

9. A nozzle as defined in claim 6 wherein said magnet is supported by said nozzle body upstream of said disc member with respect to the flow of vapor within said vapor return passage and magnetically pulls said disc member to said closed position.

10. A vapor recovery fuel dispensing nozzle comprising a nozzle body defining a fluid supply passage and a valve for controlling the supply of fuel through said fuel supply passage, said body defining a vapor return passage and a vapor control valve within said vapor return passage, a hand actuated lever pivotally supported adjacent said body and connected to operate said fuel control valve and said vapor control valve, a vapor flow responsive control valve within said vapor return passage and including a first magnetic valve member movable between a closed position contacting a valve seat member to block the flow of vapor through said vapor return passage and an open position permitting the flow of vapor through said vapor return passage, a second magnetic valve member supported by said nozzle body and magnetically attracting said first magnetic valve member to said closed position, and a magnetic force between said first magnetic valve member and said second magnetic valve member effective to move said first magnetic valve member to said closed position in response to no flow of vapor through said vapor return passage.

11. A nozzle as defined in claim 10 wherein said first magnetic valve member comprises a magnetically attractable ferrous disc supported for movement within said vapor return passage between said open position and said closed position contacting an annular said valve seat member, and said second magnetic valve member comprises a permanent magnet spaced from said disc upstream of the vapor flow within said vapor return passage.

12. A nozzle as defined in claim 11 wherein said disc and said valve seat member are generally circular and substantially flat, and said permanent magnet is generally circular and substantially flat.

13. A nozzle as defined in claim 12 and including retainer members spaced circumferentially around said disc, said annular seat member and said magnet and supporting said disc, said seat member and said magnet within a bore in said nozzle body.

* * * * *